US005427042A

United States Patent [19]

Yamasaki

[11] Patent Number: 5,427,042

[45] Date of Patent: Jun. 27, 1995

[54] HORIZONTAL ROTARY HOOK INCLUDING LOOP SPREADER

[75] Inventor: Hiroshi Yamasaki, Nagoya, Japan

[73] Assignee: Brother Kogyo Kabushiki Kaisha, Nagoya, Japan

[21] Appl. No.: 262,546

[22] Filed: Jun. 20, 1994

[30] Foreign Application Priority Data

Jul. 20, 1993 [JP] Japan ..... 5-178876

[51] Int. Cl.[6] ..... D05B 57/08

[52] U.S. Cl. ..... 112/230; 112/187

[58] Field of Search ..... 112/181, 184, 187, 191, 112/196, 202, 228, 230, 231

[56] References Cited

U.S. PATENT DOCUMENTS

| | | | |
|---|---|---|---|
| 2,989,017 | 6/1961 | Taketomi | 112/187 |
| 3,139,050 | 6/1964 | Grabowski | 112/228 X |
| 3,921,551 | 11/1975 | Gustmann et al. | 112/181 |
| 4,660,487 | 4/1987 | Mikuni | 112/230 |
| 4,966,088 | 10/1990 | Badillo | 112/230 X |

FOREIGN PATENT DOCUMENTS

| | | |
|---|---|---|
| 60-149388 | 10/1985 | Japan . |
| 61-12050 | 4/1986 | Japan . |

*Primary Examiner*—Clifford D. Crowder

*Assistant Examiner*—Ismael Izaguirre

*Attorney, Agent, or Firm*—Oliff & Berridge

[57] ABSTRACT

A horizontal rotary hook has an outer rotating hook body provided with a mounting protrusion protruding from the outer circumference of the side wall thereof and provided with an upper mounting surface and a side mounting surface. A thread catching member is placed movably on the upper mounting surface of the mounting protrusion, the horizontal position of the thread catching member relative to the axis of the outer rotating hook body is determined by using a positioning jig, and then the thread catching member is fixed to the mounting protrusion of the outer rotating hook body by welding. A loop expanding member is joined to the thread catching member so as to stand perpendicularly to the upper surface of the thread catching member and a part of the loop expanding member is fixed to the side mounting surface of the mounting protrusion by welding. Since the horizontal position of the thread catching member is adjustable, the component parts of the horizontal rotary hook need not be formed in a very high dimensional accuracy but the horizontal rotary hook can be assembled with a high accuracy in order to prevent stitch skipping and noise generation, and can be manufactured at a reduced cost.

20 Claims, 4 Drawing Sheets

HORIZONTAL ROTARY HOOK INCLUDING LOOP SPREADER

BACKGROUND OF THE INVENTION

1. Field of the Invention

The invention relates to a horizontal rotary hook having an outer rotating hook assembly that rotates about an axis of rotation parallel to the direction of vertical motion of the needle and, more specifically, to a horizontal rotary hook having an outer rotating hook assembly comprising an outer rotating hook body and a hook member formed of a material different from that of the outer rotating hook body.

2. Description of the Related Art

A known horizontal rotary hook disclosed in Japanese Utility Model Laid-open (Kokai) No. Sho 60-149388 has an outer rotating hook assembly comprising an outer rotating hook body formed, by molding of a resin, in the shape of a bottomed circular cylinder and a metallic hook member curved in substantially the same curvature as that of the outer circumference of the outer rotating hook body. The hook member is attached to the outer rotating hook body so as to extend along the outer circumference of the outer rotating hook body.

The extremity of the hook member is bent inward in a circular curve having a radius smaller than that of the outer circumference of the outer rotating hook body to form a thread catching part having a sharp point. An inclined loop expanding part for vertically expanding a loop of the needle thread to make the loop of the needle thread pass under the inner rotating hook assembly is formed so as to merge into the thread catching part of the hook member. When the hook member is attached to the outer rotating hook body so as to extend along the outer circumference of the latter, the thread catching part is located at a predetermined position for catching a loop of the needle thread.

Since the hook member is attached to the outer rotating hook body so as to extend along the outer circumference of the latter, the position of the thread catching part is dependent on the respective shapes of the outer rotating hook body and the hook member. Therefore, the following problems arise if the outer rotating hook body and the hook member are formed with a low dimensional accuracy. If the thread catching part is located too far from the needle, there is the possibility that the thread catching part is unable to catch a loop of the needle thread and, consequently, a stitch cannot be formed. If the thread catching part is located too close to the path of the needle or on the path of the needle, there is the possibility that the thread catching part interferes with the needle and generates noise. Accordingly, when the hook member is attached to the outer rotating hook body so as to extend along the outer circumference of the latter, the outer rotating hook body and the hook member must be formed to a high dimensional accuracy.

Although hook members can be formed at a reduced cost by bending a metal plate so that the hook members extend along the outer circumference of the outer rotating hook body, the dimensional accuracies of such hook members vary over a wide range. Therefore, it has been inappropriate to form a hook member, to be attached to the outer rotating hook body so as to extend along the outer circumference of the latter, by press-working. On the other hand, forming a hook member with a high dimensional accuracy by machining a metal blank to prevent stitch skipping and noise generation increases the cost of the outer rotating hook assembly.

SUMMARY OF THE INVENTION

The invention has been made to solve the foregoing problems and it is therefore an object of the invention to provide an inexpensive horizontal rotary hook comprising component parts that need not be formed with a very high dimensional accuracy and capable of preventing stitch skipping and noise generation.

With the foregoing object in view, the invention provides a horizontal rotary hook comprising an outer rotating hook assembly, an inner rotating hock assembly slidably held on the outer rotating hook body of the outer rotating hook assembly, and a thread catching member for catching a loop of the needle thread, characterized in that the outer rotating hook body has a supporting part horizontally protruding from the outer circumference thereof, a loop expanding member disposed substantially perpendicularly to the thread catching member and having an inclined loop expanding part for expanding a loop of the needle thread so that the upper part of the loop is able to pass over the inner rotating hook assembly and the lower part of the loop is able to pass under the inner rotating hook assembly, and the thread catching member is attached in a horizontal position to the supporting part of the outer rotating hook body.

In the horizontal rotary hook of the invention, the outer rotating hook body has a supporting part substantially horizontally protruding from its outer circumference to support the thread catching member in a horizontal position, the inner rotating hook assembly is slidably held on the outer rotating hook body, the thread catching member having a sharp point catches a loop of the needle thread as the outer rotating hook body rotates, the loop expanding member having a sharp point is extended across the thread catching member to expand a loop of the needle thread caught by the thread catching member so that the upper part of the loop is able to pass over the inner rotating hook assembly and the lower part of the loop is able to pass under the inner rotating hook assembly.

Thus, the horizontal position of the thread catching member relative to the outer rotating hook body is adjustable. Therefore, the thread catching member can be accurately positioned on the outer rotating hook body even if the outer rotating hook body and the thread catching member are not formed with a very high accuracy. The outer rotating hook assembly can be manufactured at a reduced cost because the component parts need not be formed in a very high accuracy and hence the machining cost is not very high. Furthermore, the horizontal rotary hook will not generate noise during operation, will not cause stitch skipping and enables forming neat seams.

BRIEF DESCRIPTION OF THE DRAWINGS

Preferred embodiments of the invention will be described in detail with reference to the accompanying drawings, wherein.

DETAILED DESCRIPTION OF THE PREFERRED EMBODIMENTS

The structure of a generally known sewing machine will be briefly described prior to the description of the preferred embodiments of the invention. A horizontal bed is mounted on a main frame and a flat throat plate is placed on the upper surface of the bed. An arm is set on the right-hand end of the bed. A driving shaft is supported for rotation within the arm and a main motor is connected operatively with the driving shaft to drive the driving shaft for rotation. A needle bar is supported for vertical motion in synchronism with the rotation of the driving shaft opposite to the bed on the left-hand end of the arm. A needle for forming stitches with a needle thread is detachably clamped on the lower end of the needle bar.

The throat plate is provided substantially in the central part thereof with a needle hole through which the needle moves vertically. A horizontal rotary hook 24 (FIG. 2) is disposed under the throat plate to form stitches in a work in cooperation with the needle.

The horizontal rotary hook 24 in a first embodiment according to the invention will be described hereinafter with reference to FIGS. 1A, 1B, 2 and 3.

Figure 2:
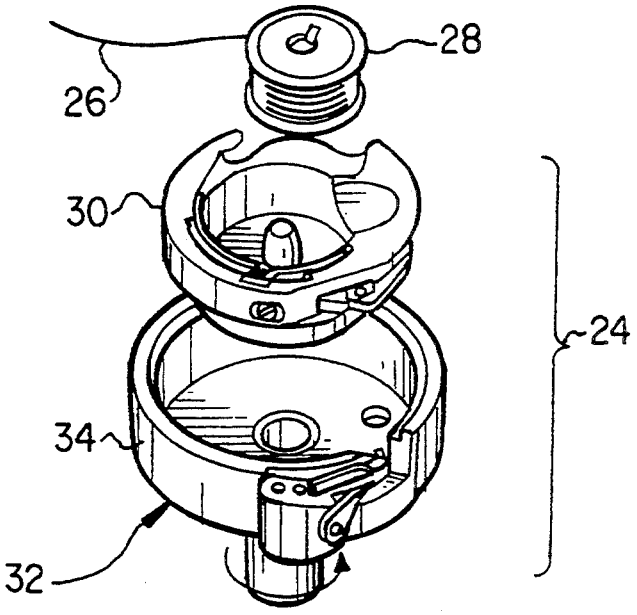
FIG. 2 is an exploded perspective view of a horizontal rotary hook in the embodiment of the invention.

Referring to FIG. 2, the horizontal rotary hook 24 comprises, as principal components, an inner rotating hook assembly 30 for containing a bobbin 28 holding bobbin thread 26 and an outer rotating hook assembly 32.

Figure 1A:
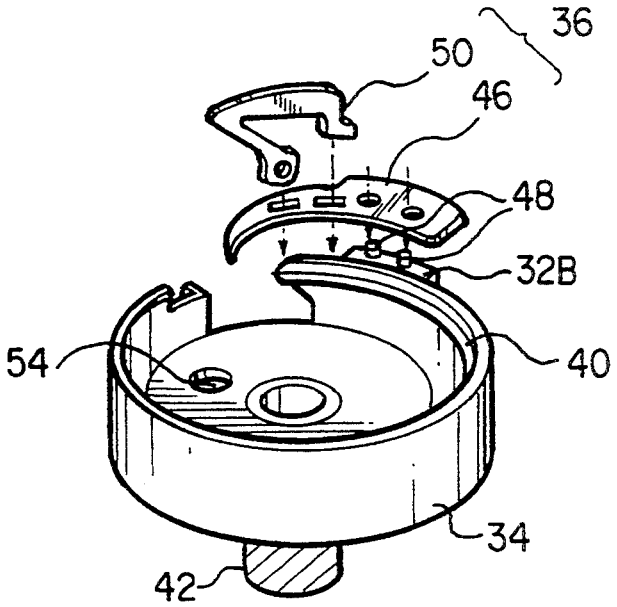
FIG. 1A is an exploded perspective view of an outer rotating hook assembly included in a horizontal rotary hook in an embodiment of the invention.
Figure 1B:
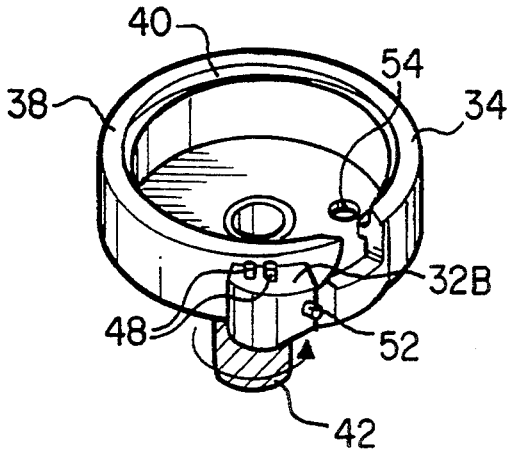
FIG. 1B is a perspective view of an outer rotating hook body included in the outer rotating hook assembly of FIG. 1A.

As shown in FIGS. 1A and 1B, the outer rotating hook assembly 32 comprises an outer rotating hook body 34 formed of a resin in a cup-like shape, and a metallic hook assembly 36. The upper surface 38 of the side wall of the outer rotating hook body 34 is stepped slightly to form a race 40 on which the inner rotating hook assembly 30 slides relative to the outer rotating hook assembly 32. A metallic shaft 42 is incorporated into the outer rotating hook body 34 by insert molding so as to extend downward from the center of the bottom wall of the outer rotating hook body 34. When the outer rotating hook assembly 32 is incorporated into the sewing machine, the shaft 42 is set in a vertical position, i.e., in parallel to the direction of vertical motion of the needle. When the sewing machine operates, the shaft 42 is driven for rotation as the driving shaft extended within the arm rotates to rotate the outer rotating hook assembly 32 in a horizontal plane relative to the inner rotating hook assembly 30. A recess is formed in the side wall of the outer rotating hook body 34, and a mounting protrusion 32B is formed so as to protrude horizontally from the outer circumference of the side wall of the outer rotating hook body 34 at a position before the recess with respect to the direction of rotation of the outer rotating hook assembly 32. Two welding pins 48 for fastening a thread catching member 46 to the horizontal upper surface of the mounting protrusion 32B project from the upper surface of the mounting protrusion 32B. A welding pin 52 for fastening a loop expanding member 50 to the outer rotating hook body 34 projects from the side surface of the mounting protrusion 32B substantially along the outer circumference of the side wall of the outer rotating hook body 34. A positioning hole 54 for receiving a positioning pin of a fixing jig, not shown, for fixing the outer rotating hook assembly 32 is formed in the bottom wall of the outer rotating hook body 34.

Figure 3:
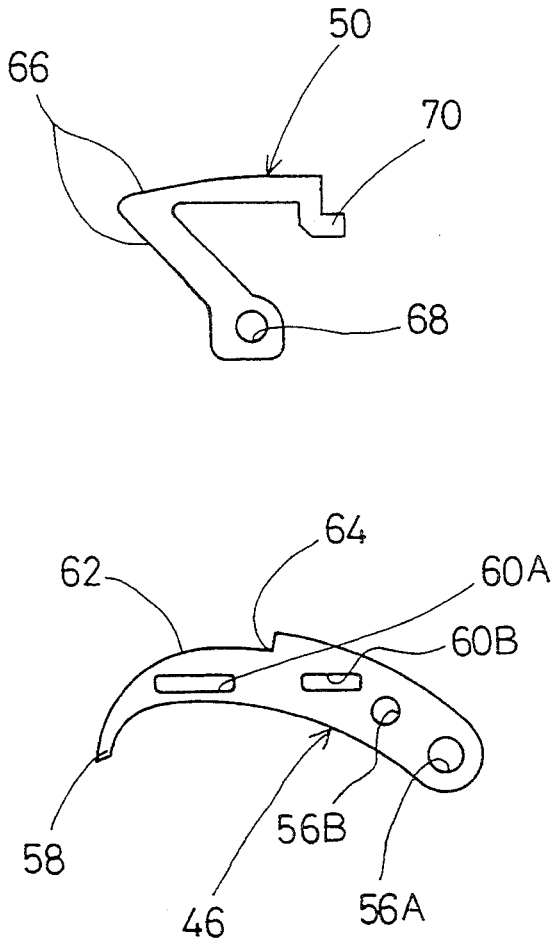
FIG. 3 is a front view of a loop expanding member included in the horizontal rotary hook of FIG. 2.

The hook assembly comprises the arcuate thread catching member 46 formed of a metal and the substantially V-shaped loop expanding member 50 formed of a metal as shown in FIG. 3. Both the thread catching member 46 and the loop expanding member 50 are punched out from a steel plate.

The thread catching member 46 is provided with holes 56A and 56B respectively at a position near one end thereof and a position substantially at the middle thereof. When the thread catching member 46 is seated on the upper mounting surface of the mounting protrusion 32B, the welding pins 48 extend through the holes 56A and 56B. The diameter of the hole 56A is about 2.2 mm, that of the hole 56B is about 2.0 mm and those of the welding pins 48 are about 2.0 mm.

A thread catching part 58 for catching a loop of the needle thread held by the needle is formed in the other end of the thread catching member 46. The thread catching part 58 is curved gently inward so that the same extends toward the center of the outer rotating hook body 34 when the thread catching member 46 is attached to the mounting protrusion 32B of the outer rotating hook body 34.

Rectangular holes 60A and 60B are formed in the middle part of the thread catching member 46 to receive the opposite ends of the loop expanding member 50 therein so that the loop expanding member 50 is set perpendicularly to the upper surface of the thread catching member 46.

A guide edge 62 is formed in the outer arcuate edge of the thread catching member 46 so as to merge into the outer edge of the thread catching part 58. A loop of the needle thread caught by the thread catching part 58 slides along the guide edge 62. The guide edge 62 terminates in a step 64 for stopping a loop caught by the thread catching member 46.

The loop expanding member 50 has a substantially V-shaped nose 66 for expanding a loop of the needle thread, and is provided at one end thereof with a hole 68 for receiving the welding pin 52 of the mounting protrusion 32B of the outer rotating hook body 34. The diameter of the hole 68 is about 2.2 mm and that of the welding pin 52 is about 2.0 mm. The loop expanding member 50 is provided at the other end thereof with a bend 70 that engages the rectangular hole 60B of the thread catching member 46.

The fixing jig, not shown, is provided with an upright positioning pin that is closely fitted in the positioning hole 54, and a vertical hole that receives the shaft 42 of the outer rotating hook body 34. The positioning jig, not shown, is used for correctly positioning the thread catching member 58 on the outer rotating hook body 34 relative to the axis of the shaft 42.

A procedure for mounting the thread catching member 46 and the loop expanding member 50 to the outer rotating hook body 34 will be described hereinafter.

First, the outer rotating hook body 34 is held in a horizontal position on the fixing jig with the positioning pin of the fixing jig fitted in the positioning hole 54 and with the shaft 42 fitted in the positioning hole of the fixing jig. In this state, the outer rotating hook body 34 is restrained from turning relative to the fixing jig. Then, the thread catching member 46 is seated on the upper mounting surface of the mounting protrusion 32B with the welding pins 48 of the mounting protrusion 32B fitted in the holes 56A,56B of the thread catching member 46. Since the diameter of the hole 56A is greater than that of the welding pin 48, and the diameter of the hole 56B is approximately equal to that of the welding pin 48, the thread catching member 46 can be turned in a horizontal plane in a narrow angular range on the welding pin 48 fitted in the hole 56B.

Then, the horizontal position of the thread catching member 46 on the mounting protrusion 32B is adjusted so that the thread catching member 46 is in close contact with the positioning jig. In this state, the thread catching part 58 is positioned correctly relative to the axis of the shaft 42. Then, the welding pins 48 are fused by an ultrasonic welder to fasten the thread catching member 46 to the mounting protrusion 32B of the outer rotating hook body 34. The thread catching member 46 is thus positioned correctly and fixed to the outer rotating hook body 34, so that the thread catching part 58 thereof is able to catch a loop of the needle thread when the outer rotating hook assembly 32 rotates.

Then, the end provided with the hole 68 of the loop expanding member 50 is inserted from above into the rectangular hole 60A so as to receive the welding pin 52 of the mounting protrusion 32B of the outer rotating hook body 34 in the hole 68, and the bend 70 of the loop expanding member 50 is inserted in the rectangular hole 60B to position the loop expanding member 50 relative to the thread catching member 46. Then, the welding pin 52 is fused by the ultrasonic welder to fasten the loop expanding member 50 to the mounting protrusion 32B of the outer rotating hook body 34. The loop expanding member 50 is able to expand vertically a loop of the needle thread caught by the thread catching member 46.

The hook is formed by thus combining the thread catching member 46 and the loop expanding member 50. Therefore, even if the loop expanding member 50 for expanding a loop of the needle thread is fixed to the side mounting surface of the mounting protrusion 32B of the outer rotating hook body 34, the thread catching member 46 having the thread catching part 58 can be fixed to the horizontal upper mounting surface of the mounting protrusion 32B by a fastening action acting perpendicularly to a plane in which the outer rotating hook assembly 32 rotates. Accordingly, the position of the thread catching part 58 can be correctly adjusted by means of the positioning jig before fastening the thread catching member 46 to the mounting protrusion 32B by welding. As a result, the thread catching part 58 can be correctly positioned regardless of the dimensional accuracy of the associated parts.

Since the two plate-shaped component parts of the hook, i.e., the thread catching member 46 and the loop expanding member 50, can be horizontally moved for positional adjustment, the dimensional accuracies of the two component parts need not be very high and hence the thread catching member 46 and the loop expanding member 50 can be formed by press-working at a reduced cost.

The invention is not limited in its practical application to the foregoing embodiment specifically described herein and many changes and variations are possible therein without departing from the scope thereof.

For example, the thread catching member 46 and the loop expanding member 50 may be formed by press-working a plate of aluminum, titanium, lead or an alloy. The thread catching member 46 may be formed of an abrasion resistant nonmetallic material, such as a ceramic material, a plastic material or a synthetic resin.

Although the upper mounting surface of the mounting protrusion 32B is formed so that the same is included in a horizontal plane when the outer rotating hook body 34 is incorporated into the sewing machine, the upper mounting surface of the mounting protrusion 32B may be slightly inclined to the horizontal plane in the same condition to enable the simultaneous adjustment of the horizontal position and the vertical position of the thread catching member 46.

Although the diameter of the hole 56B is smaller than that of the hole 56A in the foregoing embodiment, the diameter of the hole 56B may be as large as that of the hole 56A.

Figure 4:
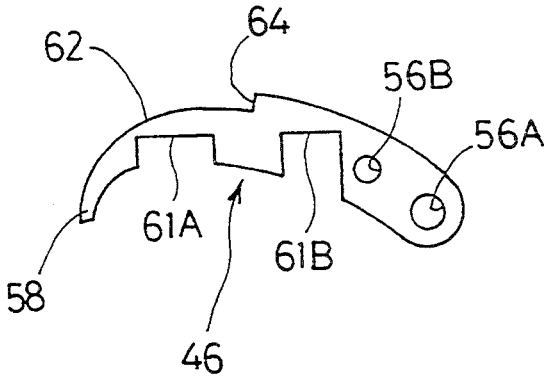
FIG. 4 is a front view of a thread catching member in a modification of a thread catching member employed in the horizontal rotary hook of FIG. 2.

Furthermore, the thread catching member 46 may be provided with recesses 61A and 61B as shown in FIG. 4 instead of the rectangular holes 60A and 60B.

What is claimed is:

1. A horizontal rotary hook, comprising:

an outer rotating hook assembly having an outer rotating hook body;

an inner rotating hook assembly slidably supported on said outer rotating hook body;

a thread catching member for catching a loop of the needle thread, wherein said outer rotating hook body is provided with a mounting protrusion protruding from an outer circumference of a side wall thereof and having an upper mounting surface extending in a plane substantially perpendicular to a rotary axis of said outer rotating hook body; and a loop expanding member, having a loop expanding part for expanding a loop of the needle thread caught by said thread catching member so that an upper part of the loop is able to pass over said inner rotating hook assembly and a lower part of the loop is able to pass under said inner rotating hook assembly, is set in an upright position on an upper surface of said thread catching member, wherein said thread catching member is attached to the upper mounting surface of the mounting protrusion of said outer rotating hook body so that the same is held in a substantially horizontal position when said outer rotating hook assembly is incorporated into a sewing machine.

2. The horizontal rotary hook according to claim 1, wherein said thread catching member and said loop expanding member are different in material from said outer rotating hook body.

3. The horizontal rotary hook according to claim 1, wherein said outer rotating hook body is formed of a resin in an integral unit by molding.

4. The horizontal rotary hook according to claim 1, wherein said thread catching member is formed in an arcuate shape and is provided with a thread catching part for catching the thread in one end thereof and with a plurality of holes substantially in a middle part thereof.

5. The horizontal rotary hook according to claim 4, wherein the plurality of holes are a plurality of first holes for use in fixing said thread catching member to the upper mounting surface of the mounting protrusion and a plurality of second holes for use in fixing said loop expanding member to said thread catching member.

6. The horizontal rotary hook according to claim 5, wherein a plurality of first welding pins respectively corresponding to said first holes are formed on the upper mounting surface integrally with the mounting protrusion so as to extend respectively through said first holes of said thread catching member when said thread catching member is seated on the upper mounting surface.

7. The horizontal rotary hook according to claim 6, wherein the diameter of said first hole nearer to one end of said thread catching member is greater than that of said plurality of first welding pins.

8. The horizontal rotary hook according to claim 6, wherein the diameter of said inner first hole is greater than or equal to that of said first welding pins.

9. The horizontal rotary hook according to claim 5, wherein at least one of said second holes is a recess.

10. The horizontal rotary hook according to claim 5, wherein said loop expanding member is former in a shape substantially resembling the letter V, and is provided with a third hole in one end thereof and a bend that engages a one of said plurality of said second holes of said thread catching member in the other end thereof.

11. The horizontal rotary hook according to claim 10, wherein the mounting protrusion is provided with a side mounting surface and a second welding pin is formed on the side mounting surface to engage said third hole.

12. The horizontal rotary hook according to claim 4, wherein the curvature of the thread catching part of said thread catching member is greater than the general curvature of said thread catching member.

13. The horizontal rotary hook according to claim 4, wherein a thread guide edge is formed in an outer edge of said thread catching member so as to merge into an outer edge of the thread catching part.

14. The horizontal rotary hook according to claim 13, wherein said thread guide edge terminates in a step for stopping the thread caught by said thread catching member.

15. A horizontal rotary hook, comprising:

an outer hook body;

a mounting protrusion extending from an outer surface of said outer hook body;

a pair of welding pins extending from a first surface of said mounting protrusion;

a thread catching member having a pair of holes at one end for mounting said thread catching member to said pair of welding pins of said mounting protrusion; and a loop expanding member mounted to said thread catching member.

16. The horizontal hook according to claim 15, further comprising a third welding pin extending from a second surface of said mounting protrusion, said second surface transverse to said first surface.

17. The horizontal hook according to claim 16, wherein said loop expanding member has an angled shape, an end of a first leg having a hole for mounting said first leg to said third welding pin and a hook at an end of a second leg.

18. The horizontal rotary hook according to claim 17, wherein said thread catching member has a pair of openings at an opposite end from said pair of holes, an end of said first leg of said loop expanding member passing through a first opening of said pair of openings and said hook being engaged in a second opening of said pair of openings.

19. The horizontal rotary hook according to claim 18, wherein at least one of said openings is a recess.

20. The horizontal rotary hook according to claim 15, wherein at least one of said holes has a diameter greater than said each welding pin.

* * * * *